US008439583B2

(12) United States Patent
Kersey et al.

(10) Patent No.: US 8,439,583 B2
(45) Date of Patent: May 14, 2013

(54) TRANSPORTING A PRINT MEDIUM

(75) Inventors: Kevin T Kersey, San Diego, CA (US); Timothy J. Carlin, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 731 days.

(21) Appl. No.: 12/399,433

(22) Filed: Mar. 6, 2009

(65) Prior Publication Data

US 2010/0226704 A1 Sep. 9, 2010

(51) Int. Cl.
*B41J 15/00* (2006.01)

(52) U.S. Cl.
USPC ..... 400/621

(58) Field of Classification Search ..... 400/621
See application file for complete search history.

(56) References Cited

U.S. PATENT DOCUMENTS

| | | | | |
|---|---|---|---|---|
| 5,156,391 | A | 10/1992 | Roller | |
| 5,904,350 | A * | 5/1999 | Creighton et al. | 271/227 |
| 2004/0251613 | A1 * | 12/2004 | Quesnel | 271/243 |
| 2005/0232678 | A1 * | 10/2005 | Mochizuki et al. | 400/621 |

* cited by examiner

*Primary Examiner* — Michael G Lee
*Assistant Examiner* — Matthew Mikels
(74) *Attorney, Agent, or Firm* — Jack H. McKinney

(57) ABSTRACT

A method for transporting a print medium along a path includes controlling relative rates at which a first drive and a second drive urge the print medium downstream along the path to create a buckle in the print medium. The buckle is formed at a first zone along the path between the first and second drives. With the buckle formed in the print medium, a first operation is performed on the print medium at a second zone along the path upstream from the first zone. At the same time a second operation is performed on the print medium at a third zone downstream along the path from the first zone.

12 Claims, 4 Drawing Sheets

TRANSPORTING A PRINT MEDIUM

BACKGROUND

In a printing environment, images are formed on a print medium. That print medium can take the form of a web that is unwound and fed along a path past a print zone and on to a finishing zone where the print medium can be cut. Finishing operations such as cutting often introduce displacements into the print medium that adversely affect printing. As a consequence, printing is periodically paused slowing throughput while allowing finishing operations to conclude.

DRAWINGS

DESCRIPTION

Cutting a print medium can introduce displacements that propagate along the print medium. The holding force of transporting components such as vacuum belts and nip rollers is relatively weak. Displacements introduced to a print medium often propagate through such components. The displacements, if allowed to reach a print zone, can introduce unwanted results. Even microscopic shifts in the print medium can cause degradation in print quality. Even if the print medium is stopped to allow a finishing operation to conclude, the resulting displacements in the print medium can reach the print zone.

Various embodiments described below were developed in an effort to reduce if not eliminate, the adverse effects finishing operations such as cutting can have on print quality. In particular, various embodiments discussed below introduce a buckle into a print medium positioned between a printing zone and a finishing zone. The buckle decouples or absorbs the displacements introduced by finishing operations. Introducing the buckle also helps to improve system throughput. With the buckle in place, the print medium can be advanced through a print zone without regard to the finishing operation. In other words, the print medium can be advanced through the print zone while at the same time advancement of the same print medium through a finishing zone may be slowed, paused or even reversed. The term print medium as used herein represents a single medium on which an image can be formed. A print medium can take the form of a continuous web or a single sheet. The embodiments shown in the figures and described below are examples. Other embodiments are possible. Thus, nothing in the following description should be construed to limit the scope of the disclosure.

Figure 1:
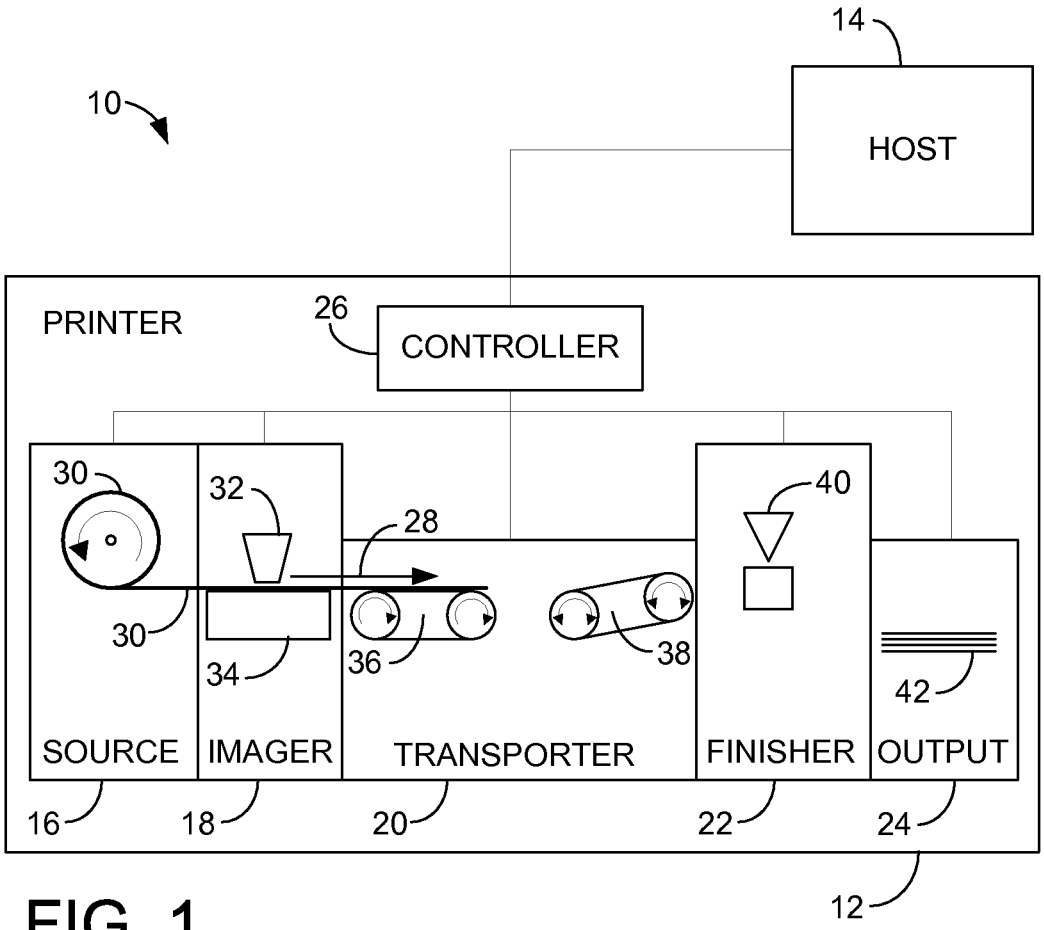
FIG. 1 is an exemplary diagram of an environment in which various embodiments may be implemented.

Components: FIG. 1 depicts an exemplary environment 10 in which various embodiments may be implemented. Environment 10 is shown to include printer 12 and host 14. Printer 12 represents generally a device capable of forming an image on a print medium. Host 14 represents a device such as a computer capable of communicating print jobs to printer 12. Such print jobs my include instructions for printing photographs on a web. Once each photograph is printed, the portion of the web on which it is formed is cut away to produce an individual printed photograph.

Figure 2:
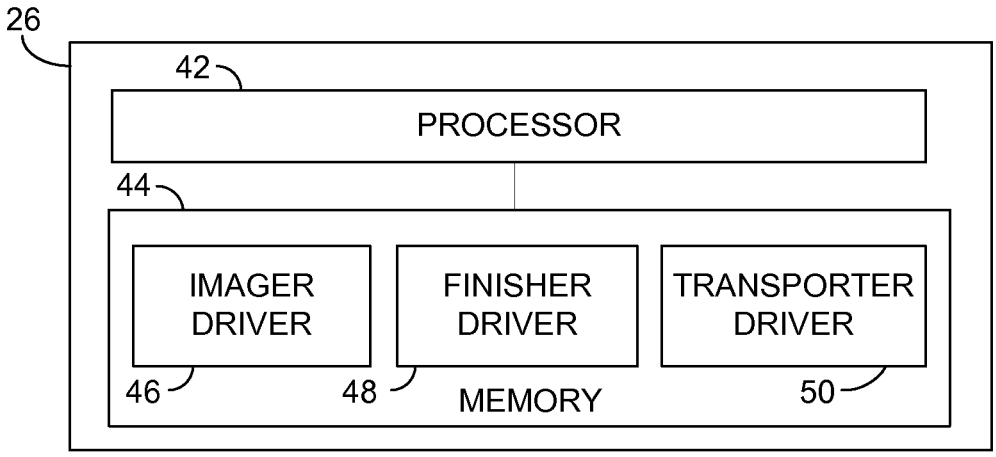
FIG. 2 is an exemplary diagram depicting the physical and logical components of a controller according to an embodiment.

As depicted in FIG. 1, printer 12 is shown to include source 16, imager 18, transporter 20, finisher 22, output 24, controller 26, and path 28 that extends through components 16-24. Source 16 represents generally any component configured to supply print medium 30 to imager 18 via path 28. In the example of FIG. 2, print medium 28 is a web. However in other implementations, print medium 28 could take the form of a single media sheet. Imager 18 represents generally a component configured to form an image on print medium 30. Imager 18 may for example utilize ink, toner, or any other substance or process capable of forming a desired image on print medium 30.

Transporter 20, described in more detail below, represents a component capable of receiving print medium 30 from imager 18 and feeding print medium 30 to finisher 22. Finisher 22 represents a component configured to perform a finishing operation with respect to print medium 30. Such a finishing operation may, for example, include cutting print medium 30. Other finishing operation may include folding, laminating, or any other operation that may alter the structure of print medium 30. Output 24 represents a component configured to receive print medium 30. Controller 26, described in more detail below, represents a component configured to selectively control the operation of source 16, imager 18, transporter 20, finisher 22, and output 24.

In a given example, host 14 may send a number of print jobs to printer 12. Controller 26 receives the print jobs and causes the various components 16-24 to produce corresponding printed images. Controller causes source 16 to feed print medium 30 through imager 18 to transporter 20. Controller 26 causes imager 18 to form desired images on print medium 30 while instructing transporter 20 to feed print medium through imager 18 and on to finisher 22. Here, imager 18 may be caused to form photographs on print medium 30 while finisher 22 is be caused to cut the photographs from print medium 30 allowing output 24 to store the printed photographs in a stack.

In the example of FIG. 1, path 28 extends from source 30, through imager 18, transporter 20, finisher 22, and concludes with output 24. While path 28 is shown as being generally linear, such need not be the case. The orientation of path 28 at any given position is at least in part a function of the respective physical orientations of components 16-24. The terms upstream and downstream as used with respect to path 28 correspond to directions of travel of print medium 30 as it moves from source 16 to output 24. In other words, imager 18 is located at a position along path 28 that is upstream from finisher 22. Print medium 30 generally travels downstream along path 28 as it passed through imager 18. As will be discussed in more detail below, print medium 30 may be caused to travel downstream, pause, and travel upstream at different times as it passes through finisher 22.

Imager 18, in the example of FIG. 1, forms images on one side of print medium 30 using ink dispensed from print head 32. Depending on the type of ink and the characteristics of print medium 30, it can prove beneficial not to touch the side of print medium 30 on which the image is formed. Thus, imager 18 is shown to include vacuum platen 34. Vacuum platen 34 receives print medium 30 from source 16 securing the opposite side from which images are formed as print medium 30 passes through imager 18.

Transport 20 is shown to include first drive 36 and second drive 38 each capable of being individually controlled to urge print media 30 along path 28. Continuing with the above example, first and second drives 28 and 29 are shown as vacuum belts each capable of securing the opposite side from which images are formed while feeding print medium 30 downstream to finisher 22. As will be discussed in more detail below, positioned between first and second drives 36 and 38 is a zone in which a buckle can be formed in print medium 30. By controlling the relative rates at which first and second drives 36 and 38 transport print medium along path 28, a buckle can be formed in print medium 30.

Finisher 22, in the example of FIG. 1, is shown to include cutter 40 responsible for cutting printed images from print medium 30. Finisher 22 works in conjunction with second drive 38. With the buckle formed in print medium 30, second drive 38 is caused to selectively, with respect to finisher 22, transport print medium 30 downstream, transport print medium 30 upstream, and pause the motion of print medium 30 to allow cutter 40 remove printed images from print medium 30. Output 24 can then organize the individual printed images in stack 42. An exemplary implementation is described below with respect to the flow diagrams of FIGS. 3-4 and the schematic diagrams of FIGS. 5-9.

FIG. 2 is an exemplary block diagram illustrating the physical and logical components of controller 26. As depicted, controller 26 includes processor 42 and memory 44. Processor 42 represents generally any component capable of executing instructions stored in memory 44 for the purposes of controlling the operation of components 16-22 of printer 12.

Memory 44 is shown to include imager driver 46, finisher driver 48, and transporter driver 50. Imager driver 46 represents generally any programming that, when executed by processor 42, is capable of causing imager 18 to perform a printing operation on print medium 30. Finisher driver 48 represents generally any programming that, when executed by processor 42, is capable of causing finisher 22 to perform a finishing operation on print medium 30.

Transporter driver 50 represents generally any programming that, when executed by processor 42, is capable of causing transport 20 to urge print medium 30 along path 28 as needed by imager 18 and finisher 22. In particular, transporter driver 50 individually controls the operation of first drive 36 and second drive 38. Transporter driver 50 causes first drive 36 to feed print medium 30 along path 28 so that imager 18 is allowed to continually form images. At the same time, transporter driver 50 causes second drive 38 to feed print medium 28 as needed by finisher 22. Those needs may involve advancing, reversing, and halting the motion of print medium 30 along path 28. Before imaging and finishing operations are performed, print medium 30 is fed into path 28 and coupled to first and second drives 36 and 38. To allow first and second drives 26 and 28 to operate independently, transporter driver 50 controls the relative rates at which first and second drives 36 and 38 feed print medium 30 along path 28. In particular first drive 36 is caused to operate at a faster rate than second drive 38. The difference in rates causes a buckle to form in print medium 30 between first and second drives 36 and 38 along path 28. Once a buckle of sufficient size has been created, transporter driver 50 can control first drive 36 in conjunction with imager driver 46 so that images can be continually formed on print medium 30. At the same time transporter driver 50 can control second drive 38 in conjunction with finisher driver 48 so that finishing operations can be performed on print medium 28 as needed without interrupting or interfering with the image formation.

Finishing operations such as cutting introduce displacements into print medium 30 that propagate upstream along path 28. The buckle (see FIGS. 5-9 for an example) formed between first and second drives 36 and 38 functions to absorb the displacement preventing further upstream propagation that might interfere with imager 18. The buckle also absorbs displacements caused by changing rates and direction of operation of second drive 38. Thus, with the buckle formed in print medium 30, imager 18 is allowed to continually print without regard to finishing operations occurring downstream.

Figure 3:
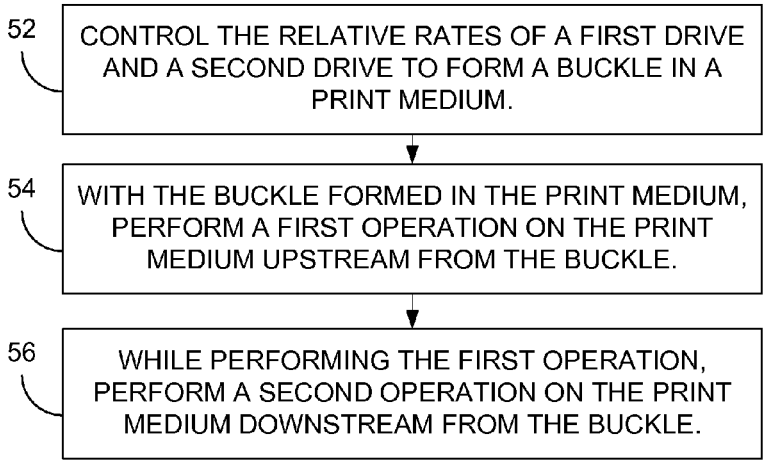
FIGS. 3 and 4 are flow diagrams depicting method implementations according to various embodiments.

Operation: FIG. 3 is an exemplary flow diagram depicting steps taken to implement an embodiment. In discussing FIG. 3, reference is made to the diagrams of FIGS. 1 and 2. These references are made to provide contextual examples. Implementation, however, is not limited to those examples. The relative rates of a first drive and a second drive are controlled to form a buckle in a print medium being fed along a path (step 52). The buckle is formed at a first zone along the print path positioned between the first and second drives. Referring back to FIGS. 1 and 2 for an example, print medium 30 is coupled to first drive 36 and second drive 38. Controller 26 controls the relative rates as drives 36 and 38 urge print medium 30 along path 28 to form a buckle between drives 36 and 38.

With buckle formed in the print medium, a first operation is performed on the print medium at a second zone along the print path upstream from the first zone (step 54). While performing the first operation, a second operation is performed on the print medium at a third zone positioned along the path downstream from the first zone (step 56). Referring back to FIGS. 1 and 2 for an example, the first operation may include printing where controller 26 causes imager 18 to form an image on print medium 30. The second operation may include cutting where controller 26 causes finisher 22 to cut a printed image from print medium 30. With respect to FIG. 1, the first zone is located along path 28 within transport 20 between drives 36 and 38. The second zone is located along path 28 within imager 18 upstream from the first zone. The third zone is located along path 28 within finisher 22 downstream from the first and second zones.

The first and second operations of steps 54 and 56 include urging the print medium along the path. In the example of FIG. 1, the first operation includes controller 26 causing drive 36 to advance print medium 30 downstream along path 28 with respect to the second zone as the first and second operations are being performed. The second operation includes controller 26 causing drive 38 to selectively urge print medium 30 along path 28 with respect to the third zone to allow finisher 22 to cut printed images. In performance of the second operation, controller 26 may, with respect to the third zone, cause drive 38 to advance print medium 30 downstream, reverse and pull print medium 30 upstream, and pause holding print medium 30 stationary. In other words, second drive 38 is caused to at least periodically oppose the downstream advancement of print medium 30 as the first and second operations are being performed. The second operation in the example of FIG. 1 introduces displacements in print medium 30. The displacements propagate within print medium 30 upstream along path 28 from the third zone. The buckle formed at the first zone prevents the displacement from propagating upstream along the path beyond the first zone to the second zone where the image is being formed.

Figure 4:
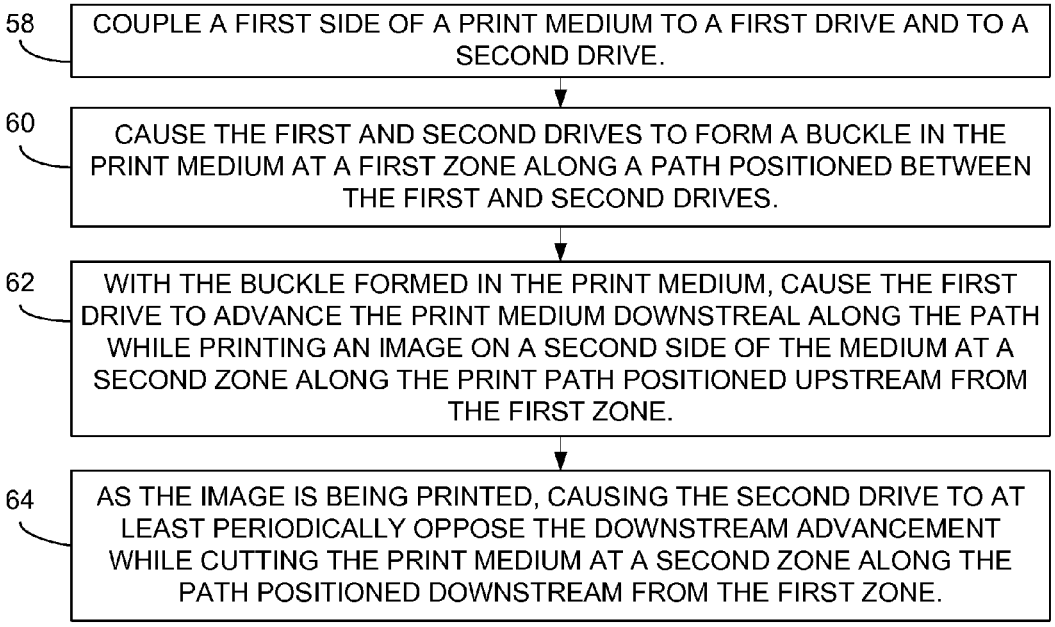
Figure 5:
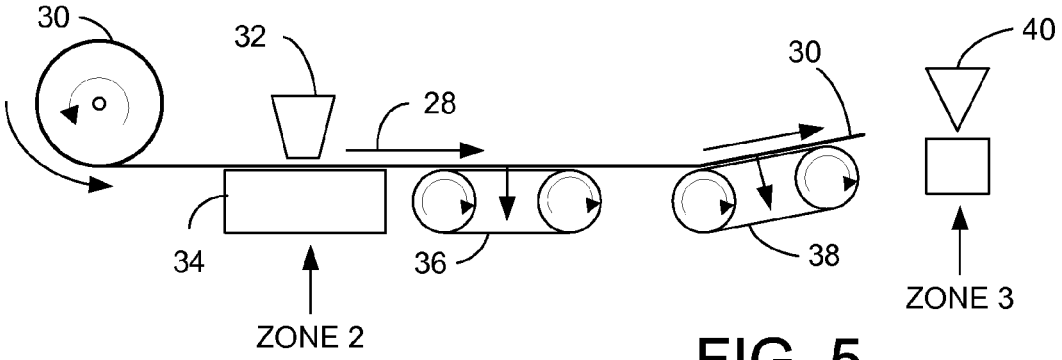
FIGS. 5-9 are diagrams depicting an example in which a print medium is transported along a path according to an embodiment.
Figure 6:
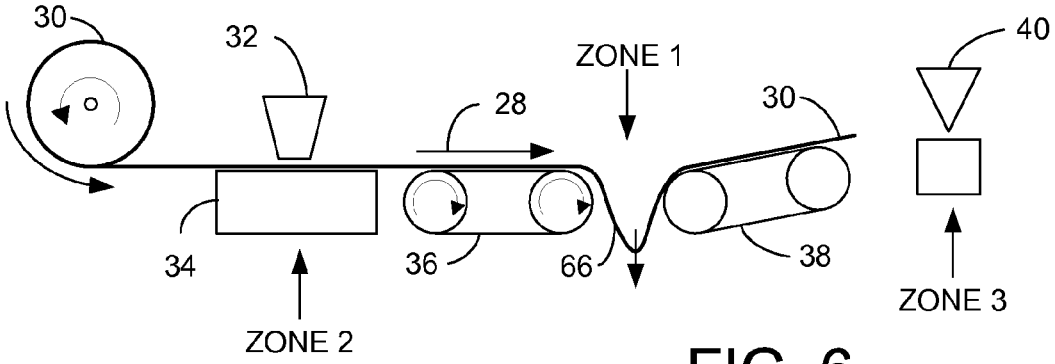

FIG. 4 is an exemplary flow diagram depicting steps taken to implement an embodiment. In discussing FIG. 4, reference is made to the diagrams of FIGS. 5-9. These references are made to provide contextual examples. Implementation, however, is not limited to those examples. A first side of a print medium is coupled to a first drive and to a second drive (step 58). Looking at FIG. 5, print medium 30 is fed along path 28 until it can be engaged by first drive 36 and second drive 38. In this example, first and second drives 36 and 38 are vacuum belts. The bottom side of print medium 30 is coupled to each drive 36 and 38. The term "bottom" is used only to differentiate one side of print medium 30 from the other with respect to the depicted orientation of FIG. 5. In other orientations, the bottom side may instead be referred to as the top, left, or right side.

The first and second drives are caused to form a buckle in the print medium at a first zone along a path positioned between the first and second drives (Step 60). Looking at FIG. 6, drive 36 is being caused to feed print medium 30 downstream along path 28 while drive 38 is holding print medium stationary. As a result, buckle 66 is formed at a first zone along path 28 between first and second drives 36 and 38. Rather than holding print medium 30 stationary, second drive 38 may feed print medium 30 downstream along path 28 at a slower rate than first drive 36.

Referring back to FIG. 4, the first drive, with the buckle formed, is caused to advance the print medium downstream along the path while printing an image on a second side of the print medium (step 62). As the image is being printed, the second drive is caused to at least periodically oppose the downstream advancement while the print medium is cut at a third zone (step 64). The third zone is positioned along the path downstream from the first zone.

Figure 7:
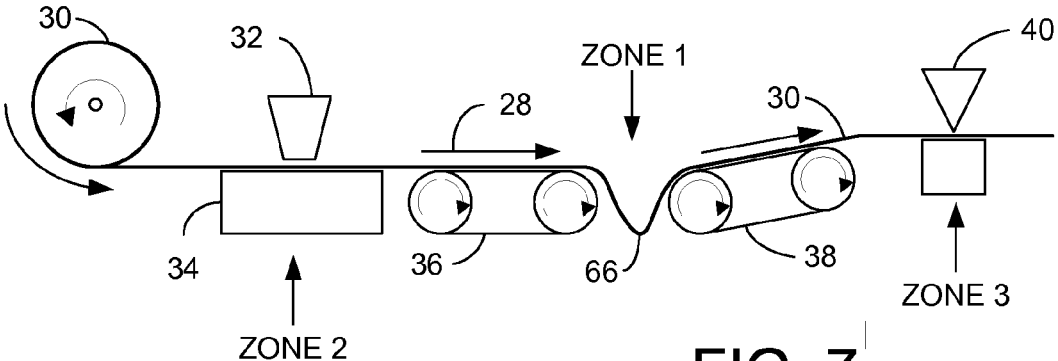

Looking at FIG. 7, first drive 36 and second drive 38 are feeding print medium 30 downstream along path 28. First drive 36 feeds print medium 30 in a manner that allows print head 32 for form a desired image on the top side of print medium 30. Second drive 38 feeds print medium 30 in a manner that allows cutter 40 to cut printed images from print medium 30. In the exemplary orientation depicted in FIG. 7, the term "top" is used only to differentiate the side of the print medium on which images are formed from the side of print medium 30 that is secured by drives 36 and 38. In other orientations, the top side may instead be referred to as the bottom, left, or right side.

Figure 8:
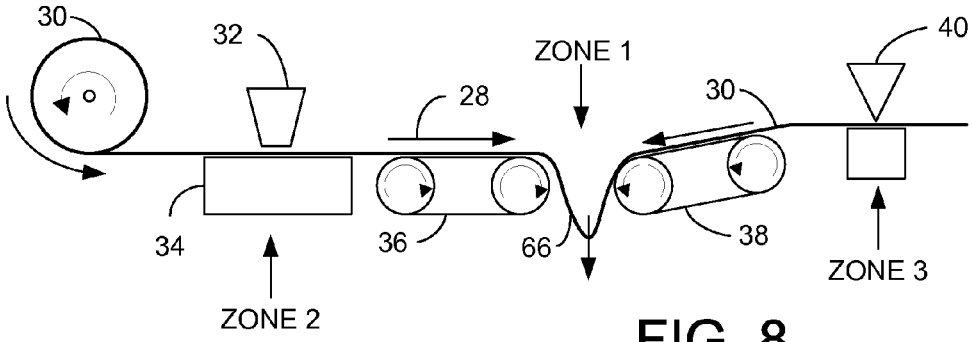
Figure 9:
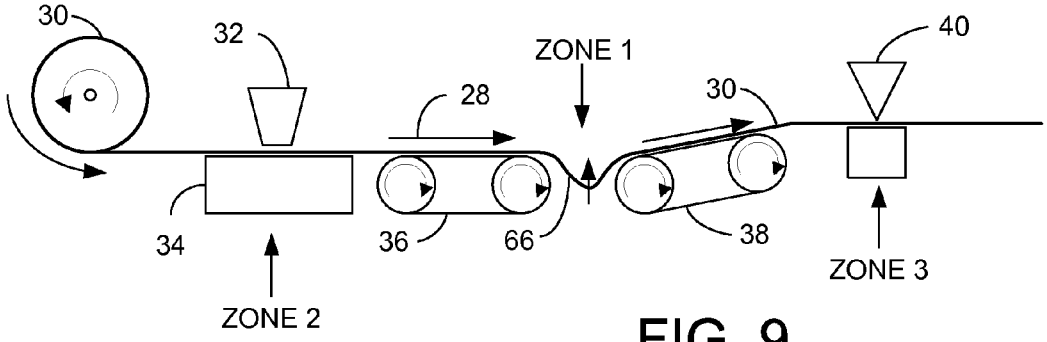

The size of buckle 66 can change depending upon the relative rates at which drives 36 and 38 feed print medium 30. Looking at FIG. 6, second drive 38 is caused to hold print medium 30 stationary with respect to the third zone while first drive 36 pulls print medium 30 through the second zone. As a result, buckle 66 grows in size. In FIG. 7, first and second drives 36 and 38 feed print medium 30 at the same rate. Thus, buckle 66 does not change in size. In FIG. 8, second drive 38 reverses direction feeding print medium 30 upstream along path 28 with respect to the third zone causing buckle 66 to grow in size. In FIG. 9, second drive 38 feeds print medium 30 at a faster rate than first drive 36 causing buckle 66 to decrease in size.

Looking at FIGS. 5-9, displacements introduced into print medium 30 caused by second drive 38 and cutter 40 propagate upstream along path 28 and are absorbed by buckle 66. The displacements are absorbed by buckle 66, potentially causing buckle 66 to change in size. The displacements do not continue upstream to the second zone where images are being formed. In this manner, first drive 36 can be controlled to advance print medium 30 downstream in a manner that allows print head 32 to continually form images on print medium 30 that are not degraded by finishing operations occurring downstream. Furthermore, buckle 66 allows second drive 38 to be controlled to at least periodically oppose the downstream advancement of print medium 30 so that cutter 40 can remove printed images without interfering with image formation.

Conclusion: The printer 12 shown in FIG. 1 is an exemplary device in which embodiments of the present invention may be implemented. Implementation, however, is not so limited. Embodiments can be implemented in any environment in which it is desirable to feed a print medium. The diagrams of FIGS. 2-3 show the architecture, functionality, and operation of various embodiments. The block controller 26 in FIGS. 2-3 is defined in part as a program. Controller 26 may represent, at least in part, a module, segment, or portion of code that comprises one or more executable instructions to implement the specified logical function(s). Controller 26 may also represent a circuit or a number of interconnected circuits to implement the specified logical function(s).

Also, the present invention can be embodied in any computer-readable media for use by or in connection with an instruction execution system such as a computer/processor based system or an ASIC (Application Specific Integrated Circuit) or other system that can fetch or obtain the logic from computer-readable media and execute the instructions contained therein. "Computer-readable media" can be any media that can contain, store, or maintain programs and data for use by or in connection with the instruction execution system. Computer readable media can comprise any one of many physical media such as, for example, electronic, magnetic, optical, electromagnetic, or semiconductor media. More specific examples of suitable computer-readable media include, but are not limited to, a hard drive, a random access memory (RAM), a read-only memory (ROM), an erasable programmable read-only memory, or a portable disc.

Although the flow diagrams of FIGS. 3-4 show specific orders of execution, the orders of execution may differ from that which is depicted. For example, the order of execution of two or more blocks may be scrambled relative to the order shown. Also, two or more blocks shown in succession may be executed concurrently or with partial concurrence. All such variations are within the scope of the present invention. FIGS. 5-9 depict an example of the formation of a buckle in a print medium. Other examples are of course possible.

The present invention has been shown and described with reference to the foregoing exemplary embodiments. It is to be understood, however, that other forms, details and embodiments may be made without departing from the spirit and scope of the invention that is defined in the following claims.

What is claimed is:

1. A method for transporting a print medium along a path comprising:

controlling relative rates at which a first drive and a second drive urge the print medium downstream along the path to create a buckle in the print medium at a first zone along the path between the first and second drives; and with the buckle formed in the print medium performing a first operation on the print medium at a second zone along the path upstream from the first zone while performing a second operation on the print medium at a third zone downstream along the path from the first zone;

wherein the first operation includes printing, the second operation is a finishing operation that introduces a displacement to the print medium that propagates upstream from the third zone along the path, and the buckle at least substantially prevents the displacement from propagating upstream along the path beyond the first zone.

2. The method of claim 1, comprising:

causing the first drive to advance the print medium downstream along the path as the first and second operations are performed; and causing the second drive to at least periodically oppose the downstream advancement of the print medium as the first and second operations are performed.

3. The method of claim 2, wherein the first operation includes forming an image on the print medium and the second operation includes cutting the print medium.

4. The method of claim 3, wherein:

at least one of the cutting and the opposition to the downstream advancement introduces a displacement to the print medium that propagates upstream from the third zone along the path; and the buckle at least substantially prevents the displacement from propagating upstream along the path beyond the first zone to the second zone where the image is being formed.

5. A computer readable medium having computer executable instructions that when executed implement a method, the method including:

controlling relative rates at which a first drive and a second drive urge the print medium downstream along the path to create a buckle in the print medium at a first zone along the path between the first and second drives; and with the buckle formed in the print medium performing a first operation on the print medium at a second zone along the path upstream from the first zone while performing a second operation on the print medium at a third zone downstream along the path from the first zone;

wherein the first operation includes printing, the second operation is a finishing operation that introduces a displacement to the print medium that propagates upstream from the third zone along the path, and the buckle at least substantially prevents the displacement from propagating upstream along the path beyond the first zone.

6. The computer readable medium of claim 5, wherein the method includes:

causing the first drive to advance the print medium downstream along the path as the first and second operations are performed; and causing the second drive to at least periodically oppose the downstream advancement of the print medium as the first and second operations are performed.

7. The computer readable medium of claim 6, wherein the first operation includes forming an image on the print medium and the second operation includes cutting the print medium.

8. The computer readable medium of claim 7, wherein:

at least one of the cutting and the opposition to the downstream advancement introduces a displacement to the print medium that propagates upstream from the third zone along the path; and the buckle at least substantially prevents the displacement from propagating upstream along the path beyond the first zone to the second zone where the image is being formed.

9. A system, comprising a path, a first drive, a second drive, and a controller, wherein:

the first drive is configured to engage a print medium and to urge the print medium along the path;

the second drive is positioned downstream along the path from the first drive and is configured to engage the print medium and to urge the print medium along the path;

the controller is configured to:

control relative rates at which a first drive and a second drive urge the print medium downstream along the path to create a buckle in the print medium at a first zone along the path between the first and second drives; and with the buckle formed in the print medium, instruct a first component to perform a first operation on the print medium at a second zone along the path upstream from the first zone while causing a second component to perform a second operation on the print medium at a third zone downstream along the path from the first zone;

wherein the first operation includes printing, the second operation is a finishing operation that introduces a displacement to the print medium that propagates upstream from the third zone along the path, and the buckle at least substantially prevents the displacement from propagating upstream along the path beyond the first zone.

10. The system of claim 9, wherein the controller is operable to:

cause the first drive to advance the print medium downstream along the path as the first and second operations are performed; and cause the second drive to at least periodically oppose the downstream advancement of the print medium as the first and second operations are performed.

11. The system of claim 10, wherein the first operation includes forming an image on the print medium and the second operation includes cutting the print medium.

12. The system of claim 11, wherein:

at least one of the cutting and the opposition to the downstream advancement introduces a displacement to the print medium that propagates upstream from the third zone along the path; and the buckle at least substantially prevents the displacement from propagating upstream along the path beyond the first zone to the second zone where the image is being formed.

* * * * *